US005333856A

United States Patent [19]

Gery

[11] Patent Number: 5,333,856

[45] Date of Patent: Aug. 2, 1994

[54] PITCHING PRACTICE APPARATUS

[76] Inventor: Jonathan S. Gery, 6549 Mission Gorge Rd., #400, San Diego, Calif. 92120

[21] Appl. No.: 47,893

[22] Filed: Apr. 19, 1993

[51] Int. Cl.[5] ..... A63B 69/40

[52] U.S. Cl. ..... 273/26 A

[58] Field of Search ..... 273/181 R, 181 A, 26 A, 273/29 A, 55 B

[56] References Cited

U.S. PATENT DOCUMENTS

| | | | |
|---|---|---|---|
| 1,142,184 | 6/1915 | Lawrence | 273/26 A |
| 2,254,986 | 9/1941 | Ziel | 273/26 A |
| 3,197,208 | 7/1965 | Makar | 273/26 A |
| 4,068,846 | 1/1978 | Forrest | 273/55 B |
| 4,210,326 | 7/1980 | Booth et al. . | |
| 4,497,485 | 2/1985 | Macosko | 273/26 A |
| 4,643,423 | 2/1987 | Wright . | |
| 4,826,164 | 5/1989 | Butcher . | |
| 4,863,166 | 9/1989 | Becera et al. . | |
| 5,083,774 | 1/1992 | Yalvac | 273/26 A |

*Primary Examiner*—Theatrice Brown

*Attorney, Agent, or Firm*—Henderson & Sturm

[57] ABSTRACT

A pitching practice apparatus (10) including a backstop member (30) stretched between a main frame member (20); wherein, the backstop member (30) is provided with a generally flaccid strike zone member (40) forming a pouch (43) that may be stretched by an auxiliary tensioning unit (15); and, wherein a strike zone obscuring unit (14) which will selectively obscure the upper and/or lower portions of the strike zone opening (37) in the backstop member (30).

3 Claims, 2 Drawing Sheets

PITCHING PRACTICE APPARATUS

TECHNICAL FIELD

The present invention relates to pitching practice apparatus in general, and in particular to a variable strike zone pitching practice apparatus that allows the user to set a predetermined height strike zone for either adults or children.

BACKGROUND ART

This invention was the subject matter of Document Disclosure Program Registration No. 251595 which was filed in the United States Patent and Trademarks Office on Apr. 26, 1990.

As can be seen by reference to the following U.S. Pat. Nos. 4,643,423; 4,863,166; 4,826,164; and 4,210,326; the prior art is replete with myriad and diverse stationary as well as variable strike zone target area pitching practice devices.

While all of the aforementioned prior art constructions are more than adequate for the basic purpose and function for which they have been specifically designed, these patented devices are deficient in one or more of the following areas: non-variability of the strike zone; limited ball stopping non-strike zone surface area; or lack of a dedicated strike zone ball collection area to let the pitcher know how many of the pitched balls were on target.

As a consequence of the foregoing situation, there has existed a longstanding need among pitchers for a new type of pitching practice apparatus that will overcome all of the combined shortcomings of the prior art devices; and, the provision of such a construction is a stated objective of the present invention.

DISCLOSURE OF THE INVENTION

Briefly stated, the pitching practice apparatus that forms the basis of the present invention comprises a framework unit that supports a backstop unit having a generally flaccid strike zone unit, plus at least one strike zone obscuring unit that is movably disposed on the framework unit to selectively obscure a selected portion of the strike zone unit, and an auxiliary tensioning unit that may be employed to expand the capacity of the generally flaccid strike zone unit.

As will be explained in greater detail further on in the specification, the pitching practice apparatus of this invention provides a practice device that allows the user to vary the surface area of the exposed strike zone unit; wherein, the backstop unit will cause the pitched balls to collect in the general area of the batter; while, the strike zone unit will collect those balls that impact on the exposed areas of the strike zone unit.

BRIEF DESCRIPTION OF THE DRAWINGS

These and other attributes of the invention will become more clear upon a through study of the following description of the best mode for carrying out the invention, particularly when reviewed in conjunction with the drawings, wherein.

BEST MODE FOR CARRYING OUT THE INVENTION

Figure 1:
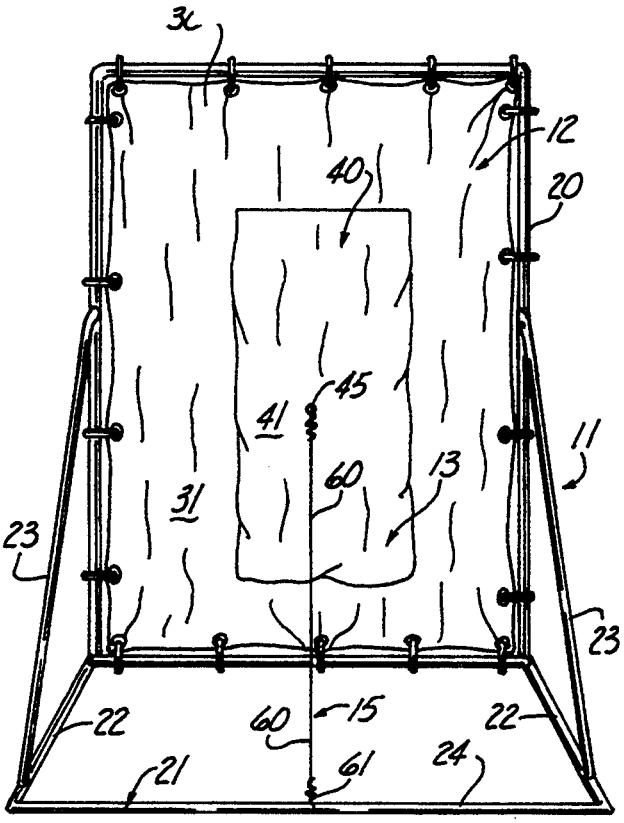
FIG. 1 is a rear perspective view of the pitching practice apparatus that forms the basis of the present invention.
Figure 5:
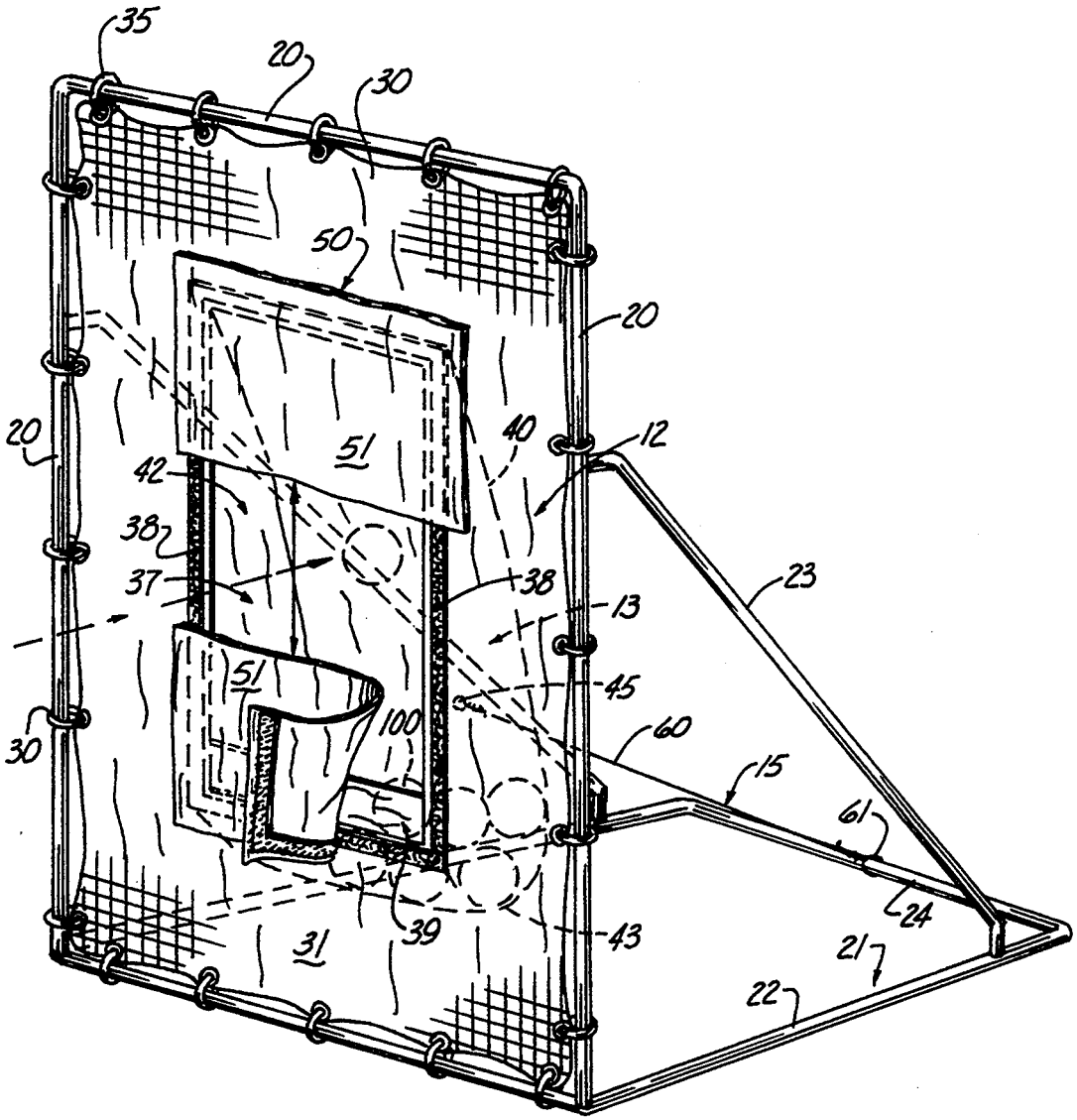
FIG. 5 is a front perspective view of the pitching practice apparatus.

As can be seen by reference to the drawings, and in particular to FIGS. 1 and 5, the pitching practice apparatus that forms the basis of the present invention is designated generally by the reference numeral (10). The apparatus (10) comprises in general: a framework unit (11); a backstop unit (12); a generally flaccid strike zone unit (13); a strike zone obscuring unit (14); and, an auxiliary tensioning unit (15). These units will now be described in seriatim fashion.

Figure 2:
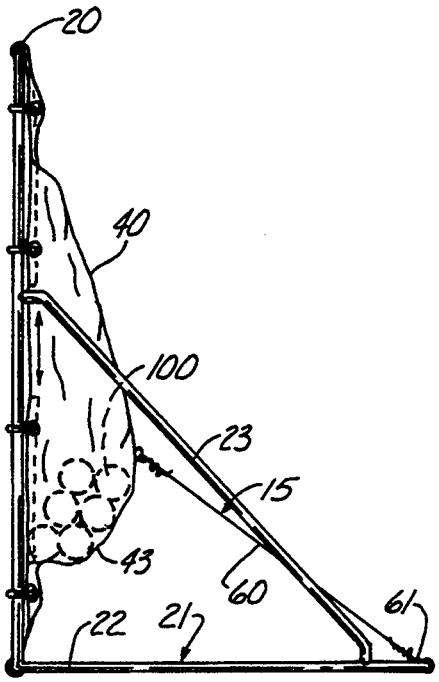
FIG. 2 is a side plan view of the apparatus.

As shown in FIGS. 1 and 2, the framework unit (11) comprises a generally rectangular vertical main framework member (20) attached to a generally U-shaped base framework member (21) wherein the main framework member (20) and the base framework member (21) are joined together in a generally L-shaped configuration. Furthermore each of the arms (22) of the U-shaped base framework member (21) are provided with brace elements (23) which extend between the base framework member (21) and the main framework member (20); and, the brace elements (23) cooperate with the leg (24) of the U-shaped base framework member (21) to provide rigidity and support to the framework unit (11).

Figure 3:
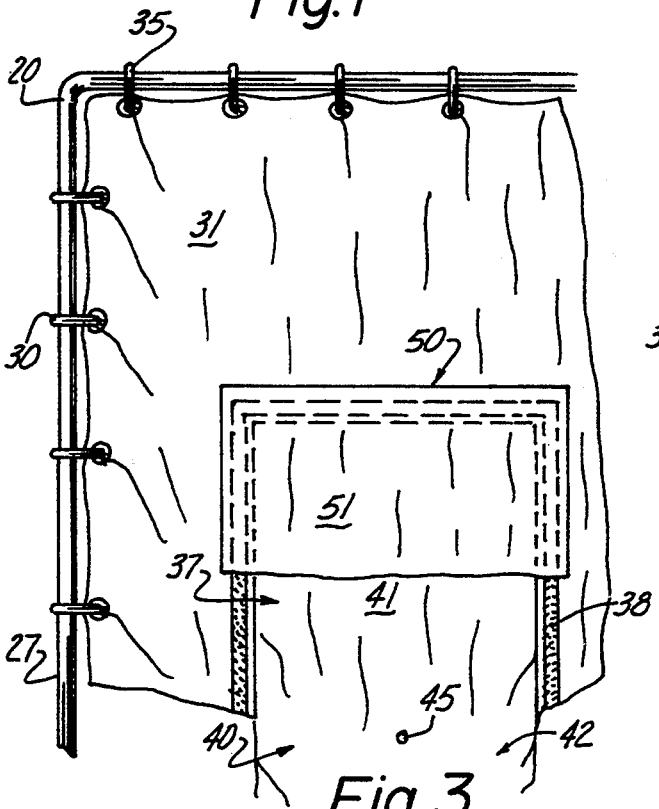
FIG. 3 is an enlarged front detail view of the upper portion of the apparatus; and, FIG. 4 is an enlarged front detail view of the lower portion of the apparatus.
Figure 4:
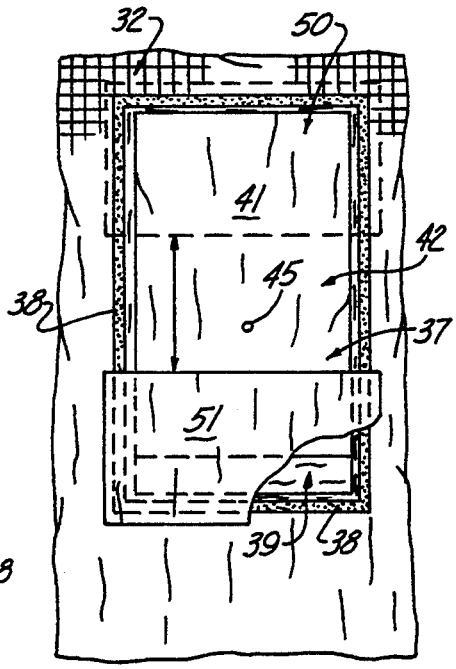

Turning now to FIGS. 1, 3 and 4, the backstop unit (12) comprises a generally rectangular backstop member (30) fabricated from either a flaccid sheet of material (31) such as canvas as shown in FIGS. 1 and 3, or as a relatively loosely draped netting material (32) such as made from nylon, gut, cord or string.

In addition the external periphery of the backstop member (30) is attached to the main framework member (21) in a suspended fashion by conventional fastening means (35) such as a plurality of ring and grommet elements as depicted in the drawings or by an elongated tether threaded through a plurality of grommets (not shown).

Furthermore, the backstop member (30) is provided with an enlarged centrally disposed vertically elongated opening (37) which is surrounded by a generally rectangular strip (38) of hook and loop fastening material; and, the lower portion of the opening (37) is provided with a raised lip (39) which will trap thrown balls that enter the opening (37) as will be explained presently.

As can best be seen by reference to FIGS. 1 and 2 the strike zone unit (13) comprises a strike zone member (40) fabricated from an elongated rectangular sheet (41) of flexible material (42) whose dimensions are greater than the dimensions of the elongated rectangular opening (37) in the backstop member (30); wherein, the peripheral edges of the sheet (41) are secured to the peripheral areas of the backstop member (30) surrounding the opening (37) to form a pouch (43) that will collect balls (100) that are thrown against the strike zone member (40).

In addition as shown in FIGS. 1, 3, and 4, the central portion of the strike zone member (40) is provided with an anchor element (45) whose purpose and function will be described presently.

Turning now to FIGS. 3 through 5, it can be seen that the strike zone obscuring unit (14) comprises a pair of strike zone obscuring members (50); wherein, each strike zone obscuring members (50) include a generally rectangular panel (51) having cooperating hook and loop fastening means which engage the hook and loop fasteners (38) on the backstop member (30) at a selected height relative to the upper and lower portions of the strike zone opening to vary the effective size of the strike zone opening.

As can also be seen by reference to FIGS. 1 and 2 the auxiliary strike zone tensioning unit (15) comprises an elasticized cord element (60) having hook elements (61) formed on its opposite ends; wherein, one of the hook elements is adapted to engage the anchor element (45) on the strike zone member (40) and the other hook (61) is adapted to engage the leg (24) of the base framework member (21) to stretch the strike zone member (40) into the configuration depicted in FIG. 2.

By now it should be appreciated that the pitching practice apparatus that forms the basis of the present invention comprises an enlarged backstop member (30) stretched between the main framework base member (21) and having an adjustable size strike zone member (40) which may be stretched into an expanded configuration by an auxiliary strike zone tensioning member (60).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A pitching practice apparatus comprising:

a framework unit including a vertically disposed generally rectangular main framework member;

a backstop unit including a generally enlarged rectangular backstop member having an enlarged generally rectangular central opening formed therein; wherein, the backstop member is supported by the main framework member which is further provided with a rearwardly projecting base framework member;

a generally flaccid strike zone unit including an enlarged generally rectangular strike zone member whose dimensions are significantly greater than the dimensions of the enlarged opening in the backstop member; wherein, the peripheral edges of the strike zone member are attached to the periphery of the backstop member adjacent said opening; such that the strike zone member forms a pouch; and, wherein the strike zone member is further provided with an anchor element;

a strike zone obscuring unit including at least one obscuring member including a generally rectangular panel suspended at a selected height on the back stop member to obscure a portion of the opening in the backstop member; and, an auxiliary tensioning unit associated with the strike zone member for stretching the strike zone member into a tensioned state; wherein, the tensioning unit comprises an elasticized cord element having hooks formed on both ends; wherein, one hook engages the anchor element on the strike zone member and the other hook engages the base framework member.

2. The apparatus as in claim 1; wherein, the strike zone obscuring units comprise a pair of obscuring members; wherein one obscuring member selectively covers the upper portion of the opening in the backstop member; and, the other obscuring member selectively covers the bottom portion of the opening in the backstop member.

3. The apparatus as in claim 1; wherein, the base framework member is attached to the main framework member to give a generally L-shaped configuration to the framework unit.

* * * * *